US012680487B2

(12) United States Patent
Kimura et al.

(10) Patent No.: US 12,680,487 B2
(45) Date of Patent: Jul. 14, 2026

(54) REDUCING AGENT SUPPLY DEVICE, METHOD FOR CONTROLLING REDUCING AGENT SUPPLY DEVICE, AND CONTROL DEVICE

(71) Applicant: Komatsu Ltd., Tokyo (JP)

(72) Inventors: Mitsuyoshi Kimura, Tokyo (JP); Tatsuya Yoshida, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 18/871,728

(22) PCT Filed: Aug. 18, 2023

(86) PCT No.: PCT/JP2023/029807
§ 371 (c)(1),
(2) Date: Dec. 4, 2024

(87) PCT Pub. No.: WO2024/053360
PCT Pub. Date: Mar. 14, 2024

(65) Prior Publication Data

US 2025/0347241 A1 Nov. 13, 2025

(30) Foreign Application Priority Data

Sep. 5, 2022 (JP) ..... 2022-140701

(51) Int. Cl.
*F01N 3/20* (2006.01)
*F01N 13/00* (2010.01)

(52) U.S. Cl.
CPC ..... *F01N 3/208* (2013.01); *F01N 3/2066* (2013.01); *F01N 13/009* (2014.06); (Continued)

(58) Field of Classification Search
CPC combination set(s) only.
See application file for complete search history.

(56) References Cited

U.S. PATENT DOCUMENTS

2013/0283769 A1* 10/2013 Watanabe ..... F01N 11/00 60/285
2015/0034189 A1* 2/2015 Burger ..... F01N 3/36 137/565.01

(Continued)

FOREIGN PATENT DOCUMENTS

EP 3106639 A1 12/2016
JP 2017-008790 A 1/2017

(Continued)

*Primary Examiner* — Binh Q Tran
(74) *Attorney, Agent, or Firm* — Troutman Pepper Locke LLP

(57) ABSTRACT

A reducing agent supply device includes a tank configured to store a reducing agent to be supplied into an exhaust pipe of an engine, pressure-feeding means configured to pressure-feed the reducing agent in the tank, a reducing agent supply channel through which the pressure-fed reducing agent is supplied, an injection nozzle configured to inject, into the exhaust pipe, the reducing agent supplied through the reducing agent supply channel, retraction means configured to retract the reducing agent in the reducing agent supply channel back to a tank side, and a control device configured to control operation of the pressure-feeding means, the injection nozzle, and the retraction means, and the control device causes the injection nozzle to repeat a switching operation in a predetermined cycle while the retraction means is being operated.

8 Claims, 6 Drawing Sheets

(52) U.S. Cl.
CPC ..... *F01N 2250/02* (2013.01); *F01N 2550/05* (2013.01); *F01N 2560/026* (2013.01); *F01N 2560/06* (2013.01); *F01N 2570/14* (2013.01); *F01N 2610/02* (2013.01); *F01N 2610/14* (2013.01); *F01N 2610/1406* (2013.01); *F01N 2610/144* (2013.01); *F01N 2610/1473* (2013.01); *F01N 2610/148* (2013.01); *F01N 2610/1493* (2013.01); *F01N 2900/0421* (2013.01); *F01N 2900/0422* (2013.01)

(56) References Cited

U.S. PATENT DOCUMENTS

| | | | | |
|---|---|---|---|---|
| 2015/0308317 | A1* | 10/2015 | Ohno | F01N 9/00 60/274 |
| 2017/0328253 | A1* | 11/2017 | Kizawa | F02D 41/0275 |
| 2019/0242284 | A1* | 8/2019 | Paielli | F01N 3/208 |
| 2019/0323399 | A1* | 10/2019 | Yudanov | F01N 9/00 |
| 2020/0009505 | A1* | 1/2020 | Verma | F01N 3/208 |
| 2022/0154614 | A1* | 5/2022 | Byrne | F01N 3/208 |

FOREIGN PATENT DOCUMENTS

| | | | |
|---|---|---|---|
| JP | 2018-044526 | A | 3/2018 |
| JP | 2018-168793 | A | 11/2018 |
| JP | 6564393 | B | 8/2019 |
| JP | 2019-157645 | A | 9/2019 |
| WO | 2016/092665 | A1 | 6/2016 |

* cited by examiner

REDUCING AGENT SUPPLY DEVICE, METHOD FOR CONTROLLING REDUCING AGENT SUPPLY DEVICE, AND CONTROL DEVICE

TECHNICAL FIELD

The present disclosure relates to a reducing agent supply device, a method for controlling a reducing agent supply device, and a control device.

Priority is claimed on Japanese Patent Application No. 2022-140701, filed Sep. 5, 2022, the content of which is incorporated herein by reference.

BACKGROUND ART

Disclosed in Patent Document 1 is a reducing agent supply device in which, for prevention of adherence of an aqueous urea solution in a urea injection device, a path between an aqueous urea solution injection device and a pump is filled with a high-pressure gas and the aqueous urea solution remaining in the aqueous urea solution injection device is blown off and removed by means of discharge of a compressed gas. In the reducing agent supply device described in Patent Document 1, a valve of the aqueous urea solution injection device needs to be closed before the discharge of the compressed gas and supply of the aqueous urea solution to the aqueous urea solution injection device. In the reducing agent supply device described in Patent Document 1, control is performed to open and close the valve at a preset timing or to open and close the valve when an in-path pressure reaches a preset value.

CITATION LIST

Patent Document

Patent Document 1: PCT International Publication No. WO2016/092665 (Japanese Patent No. 6564393)

SUMMARY OF INVENTION

Technical Problem

In the case of the reducing agent supply device described in Patent Document 1, it is possible to prevent adherence of the aqueous urea solution in the urea injection device by means of a change in pressure. However, it is required to precisely control the opening and closing of the valve based on the timing, the pressure, and the like.

The present disclosure has been made in view of the above circumstances, and an object of the present disclosure is to provide a reducing agent supply device, a method for controlling a reducing agent supply device, and a control device with which it is possible to prevent adherence of an aqueous urea solution in a urea injection device with simple control.

Solution to Problem

According to an aspect of the present disclosure, there is provided a reducing agent supply device including a tank configured to store a reducing agent to be supplied into an exhaust pipe of an engine, pressure-feeding means configured to pressure-feed the reducing agent in the tank, a reducing agent supply channel through which the pressure-fed reducing agent is supplied, an injection nozzle configured to inject, into the exhaust pipe, the reducing agent supplied through the reducing agent supply channel, retraction means configured to retract the reducing agent in the reducing agent supply channel back to a tank side, and a control device configured to control operation of the pressure-feeding means, the injection nozzle, and the retraction means, in which the control device causes the injection nozzle to repeat a switching operation in a predetermined cycle while the retraction means is being operated.

According to an aspect of the present disclosure, there is provided a method for controlling a reducing agent supply device including a tank configured to store a reducing agent to be supplied into an exhaust pipe of an engine, pressure-feeding means configured to pressure-feed the reducing agent in the tank, a reducing agent supply channel through which the pressure-fed reducing agent is supplied, an injection nozzle configured to inject, into the exhaust pipe, the reducing agent supplied through the reducing agent supply channel, retraction means configured to retract the reducing agent in the reducing agent supply channel back to a tank side, and a control device configured to control operation of the pressure-feeding means, the injection nozzle, and the retraction means, the method including a step of causing the injection nozzle to repeat a switching operation in a predetermined cycle while the retraction means is being operated.

According to an aspect of the present disclosure, there is provided a control device in a reducing agent supply device including a tank configured to store a reducing agent to be supplied into an exhaust pipe of an engine, pressure-feeding means configured to pressure-feed the reducing agent in the tank, a reducing agent supply channel through which the pressure-fed reducing agent is supplied, an injection nozzle configured to inject, into the exhaust pipe, the reducing agent supplied through the reducing agent supply channel, and retraction means configured to retract the reducing agent in the reducing agent supply channel back to a tank side, the control device controlling operation of the pressure-feeding means, the injection nozzle, and the retraction means and causing the injection nozzle to repeat a switching operation in a predetermined cycle while the retraction means is being operated.

Advantageous Effects of Invention

According to each aspect of the present disclosure, it is possible to prevent adherence of an aqueous urea solution in a urea injection device with simple control.

DESCRIPTION OF EMBODIMENTS

Figure 1:
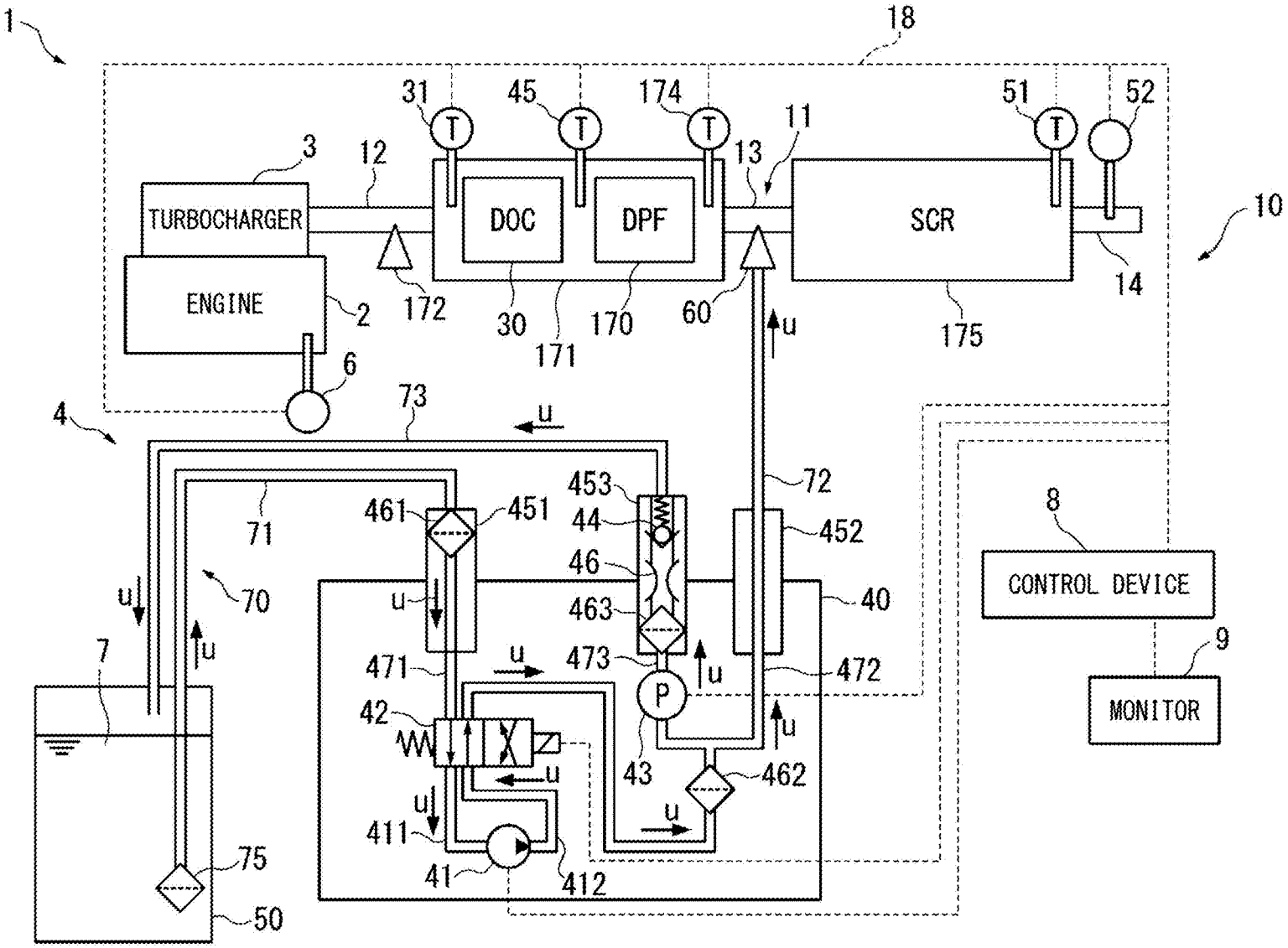
FIG. 1 A configuration diagram showing a configuration example of an exhaust gas post processing device including a reducing agent supply device according to an embodiment of the present disclosure.
Figure 2:
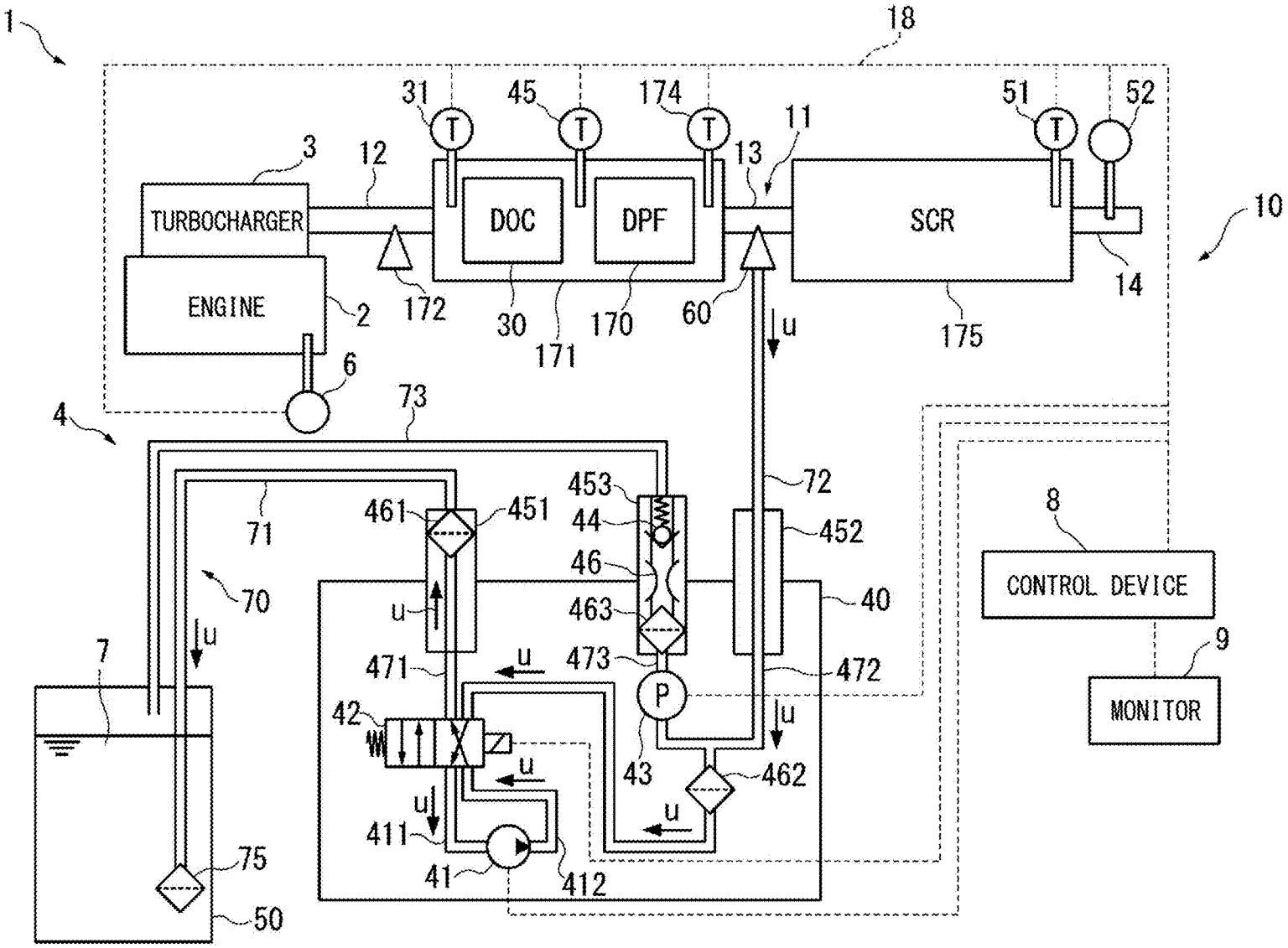
FIG. 2 A configuration diagram showing a configuration example of the exhaust gas post processing device including the reducing agent supply device according to the embodiment of the present disclosure.
Figure 3:
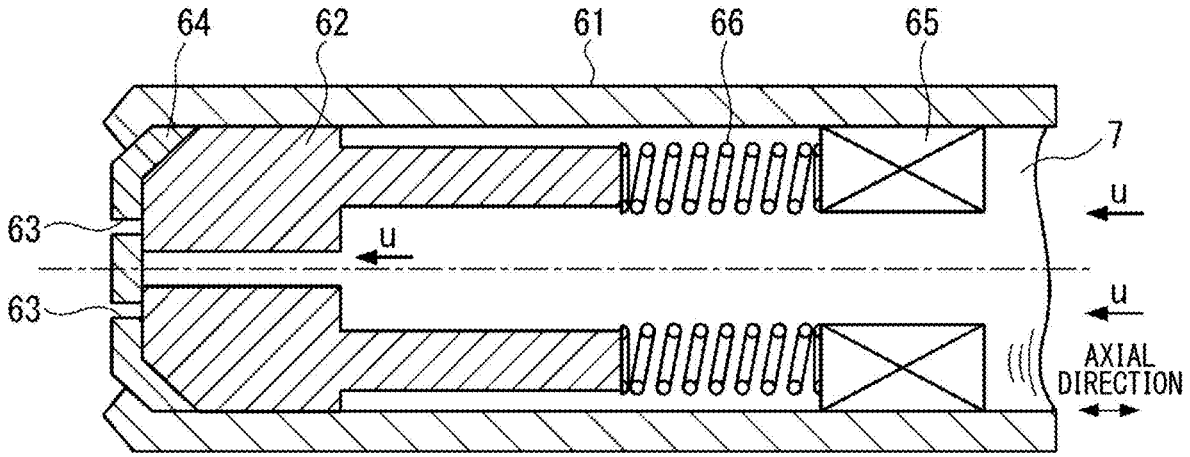
FIG. 3 A configuration diagram showing an injection nozzle in the reducing agent supply device.
Figure 4:
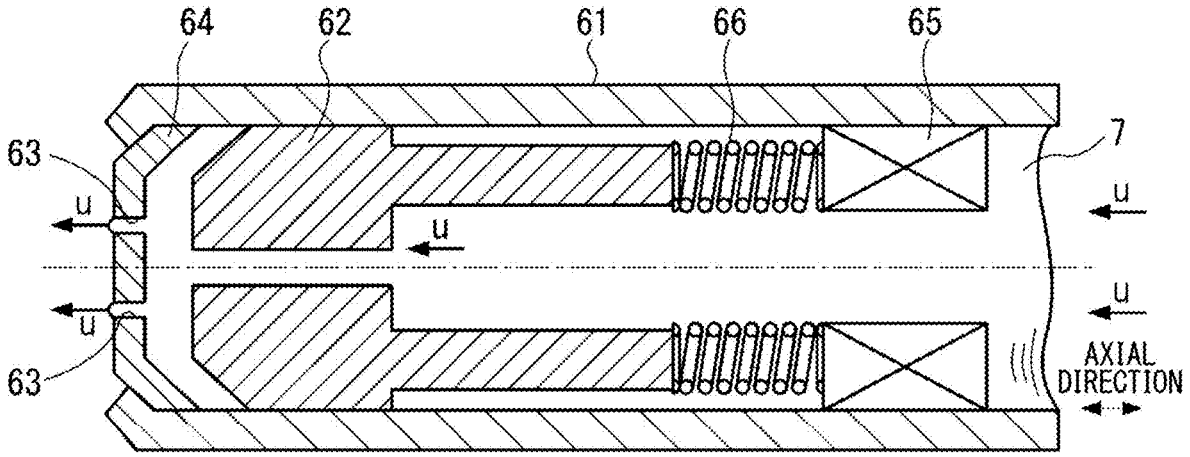
FIG. 4 A configuration diagram showing the injection nozzle in the reducing agent supply device.
Figure 5:
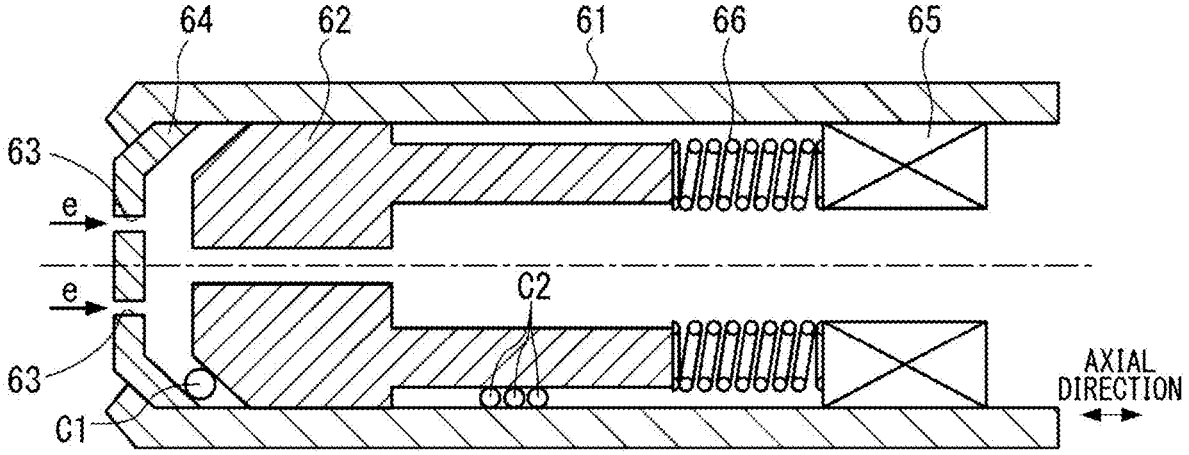
FIG. 5 A configuration diagram showing the injection nozzle in the reducing agent supply device.
Figure 6:
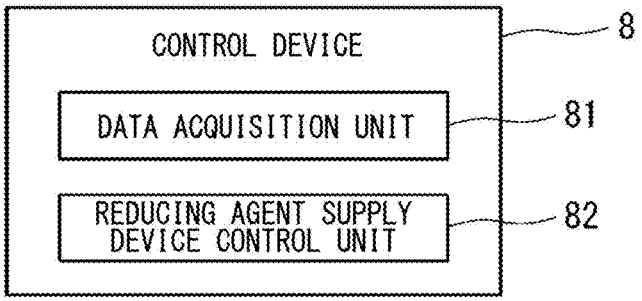
FIG. 6 A block diagram showing a configuration example of a control device according to the embodiment of the present disclosure.
Figure 7:
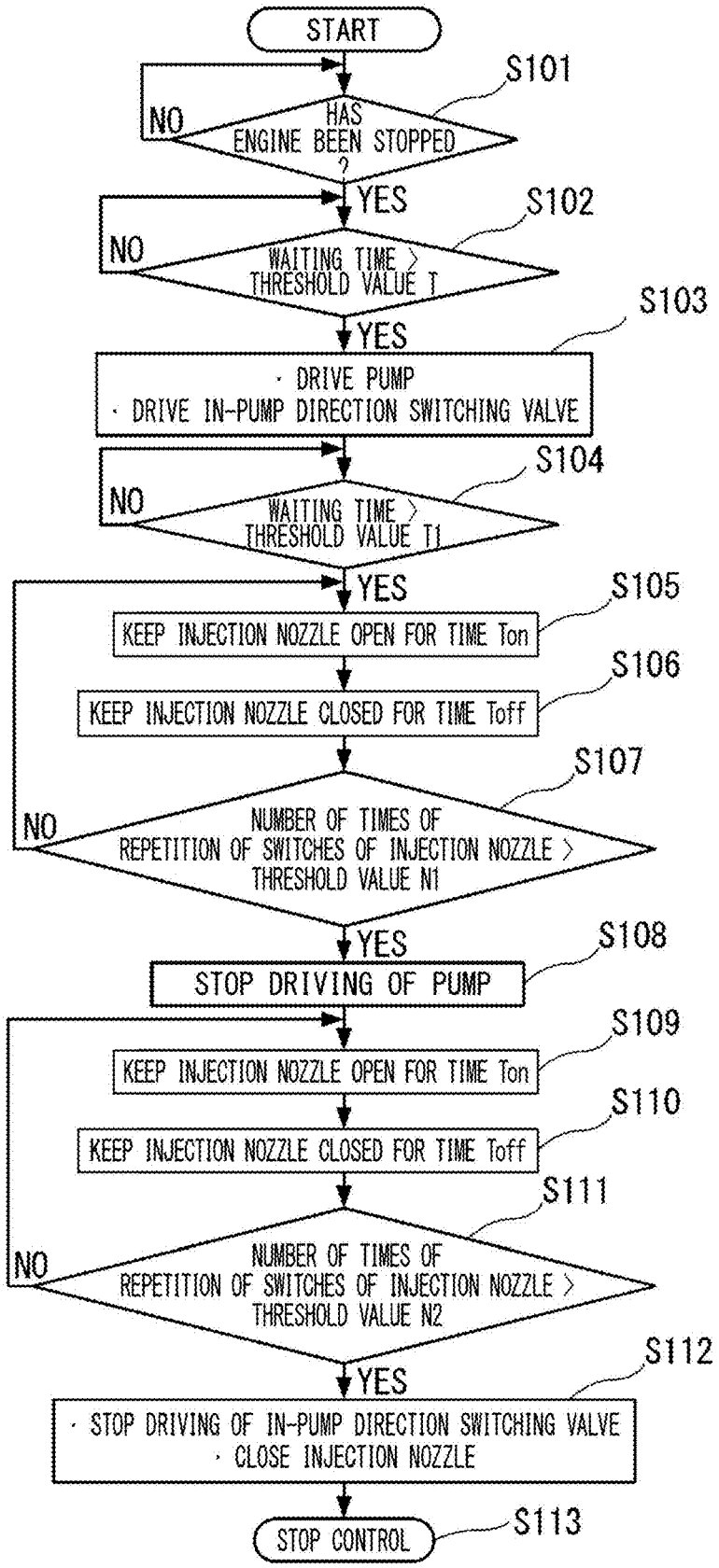
FIG. 7 A flowchart showing an operation example of the reducing agent supply device according to the embodiment of the present disclosure.
Figure 8:
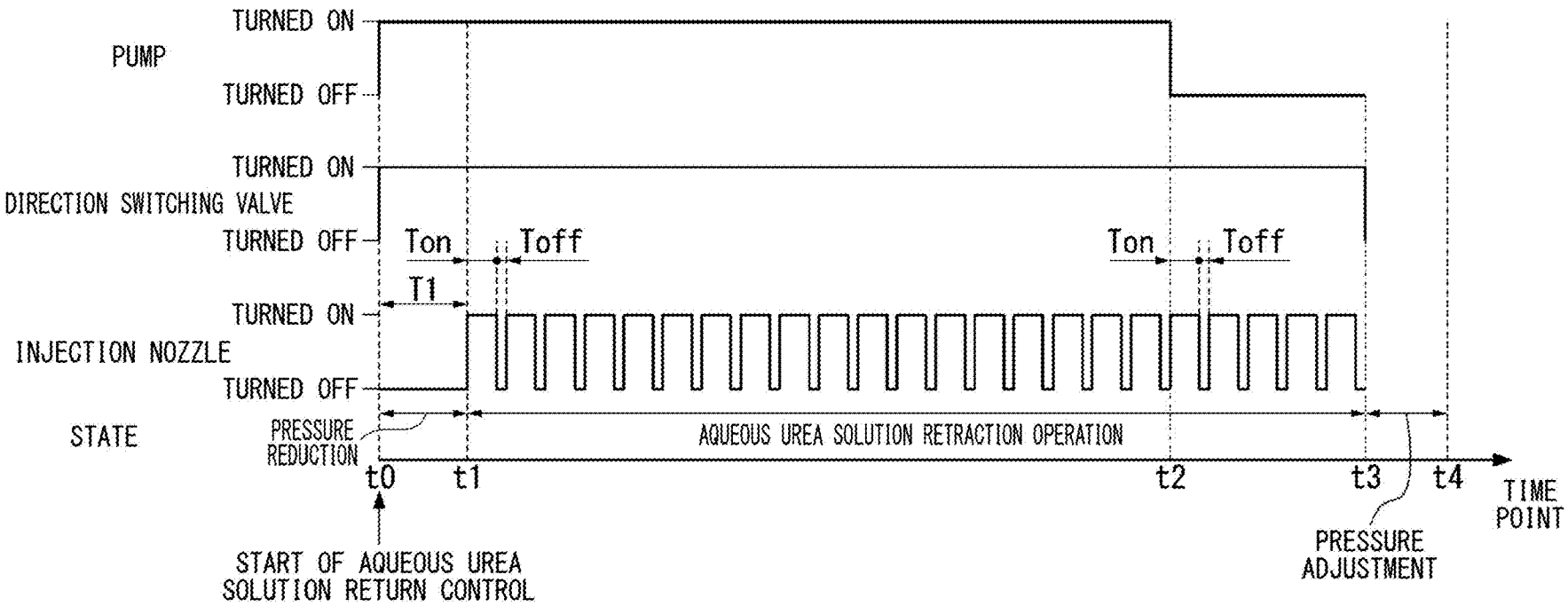
FIG. 8 A timing chart showing an operation example of the reducing agent supply device according to the embodiment of the present disclosure.

Embodiments of the present disclosure will be described below with reference to the drawings. FIGS. 1 and 2 are configuration diagrams showing a configuration example of an exhaust gas post processing device including a reducing agent supply device according to an embodiment of the present disclosure. FIGS. 3 to 5 are configuration diagrams showing an injection nozzle in the reducing agent supply device. FIG. 6 is a block diagram showing a configuration example of a control device according to the embodiment of the present disclosure. FIG. 7 is a flowchart showing an operation example of the reducing agent supply device according to the embodiment of the present disclosure. FIG. 8 is a timing chart showing an operation example of the reducing agent supply device according to the embodiment of the present disclosure. In addition, in each drawing, the same reference numerals are used for the same or corresponding components, and the description thereof will be omitted as appropriate.

[Schematic Configuration of Exhaust Gas Purification Device]

FIGS. 1 and 2 schematically show a schematic configuration of a work vehicle 1 including an exhaust gas purification device 10 according to the present embodiment. Here, the work vehicle 1 is, for example, a work machine that performs work such as excavation and leveling or performs transportation of soil and the like at a construction site such as a mine or a road and for example, a construction machine such as a hydraulic shovel, a wheel loader, a bulldozer, a motor grader, and a crane, or a transportation vehicle such as a dump truck and a forklift corresponds to the work vehicle 1. Since the exhaust gas purification device 10 of the present embodiment purifies an exhaust gas of a diesel engine, the exhaust gas purification device 10 can be used not only for the work vehicle 1 but also for various vehicles or devices including diesel engines. The work vehicle 1 includes a diesel engine 2 (hereinafter, also referred to as an engine), a turbocharger 3 in which a turbine is rotated by an exhaust gas of the diesel engine 2 so that air to be supplied to the diesel engine 2 is compressed, a control device 8, a monitor 9, and the exhaust gas purification device 10. Note that FIGS. 1 and 2 show a state where a direction switching valve 42 (also referred to as an in-pump direction switching valve) which will be described later is OFF (FIG. 1) and a state where the direction switching valve 42 is ON (FIG. 2), and an arrow u shows a direction in which an aqueous urea solution 7 flows.

The diesel engine 2 is provided with an engine rotation speed detection device 6 that detects the rotation speed of the engine and a fuel injection device (not shown) that injects fuel into the diesel engine 2. Detection data of the engine rotation speed detection device 6 is output to the control device 8. In addition, the control device 8 controls the fuel injection device (not shown) in accordance with an operation performed on an accelerator or the like.

[Monitor]

The monitor 9 includes a display unit and an input unit. The display unit is composed of a liquid crystal display or the like. The display unit displays various items of information such as a cooling water temperature and the amount of remaining fuel, a caution, and the like.

[Exhaust Gas Purification Device]

The exhaust gas purification device 10 performs a process of collecting or reducing a residual substance such as a particulate matter (hereinafter, abbreviated to "PM") or nitrogen oxide (NOx) in an exhaust gas, and is controlled by the control device 8. The exhaust gas purification device 10 includes a fuel injection device 172, a DPF device 171, a reducing agent supply device 4, and a selective catalytic reduction (SCR) device 175 in order from an upstream side in a direction in which an exhaust gas discharged from the diesel engine 2 flows. The DPF device 171 includes a diesel oxidation catalyst (hereinafter, abbreviated to "DOC") device 30 and a diesel particulate filter (DPF) 170. The DPF device 171, the reducing agent supply device 4, and the SCR device 175 are provided in the middle of a path 11 through which the exhaust gas from the diesel engine 2 flows. The path 11 includes an inlet pipe 12 through which an exhaust gas from the turbocharger 3 connected to the diesel engine 2 is introduced into the DPF device 171, an outlet pipe 13 that connects the DPF device 171 and the SCR device 175 to each other, and an outlet pipe 14 that is connected to an outlet of the SCR device 175. In addition, the outlet pipe 13 includes a mechanism that diffuses an aqueous urea solution supplied from the reducing agent supply device 4. The path 11 corresponds to an exhaust pipe of the engine 2 according to the present disclosure.

[DPF Device]

The DPF device 171 includes the DOC device 30 and the DPF 170, collects the PM with the DPF 170, generates carbon dioxide by oxidizing the PM collected downstream by using nitrogen dioxide converted by the DOC device 30, and removes the PM.

[DOC Device]

The DOC device 30 includes a case, and a diesel oxidation catalyst is accommodated in the case. The DOC device 30 is a catalyst that oxidizes fuel (hereinafter, the fuel will be referred to as dosing fuel and supply of the dosing fuel will be referred to as fuel dosing), which is supplied into an exhaust gas as necessary, to generate heat and increase the temperature of the exhaust gas such that the temperature reaches a predetermined high temperature range. The exhaust gas of which the temperature has been increased is used to decompose, remove, and reproduce urea deposits accumulated in the outlet pipe 13 or the like, which will be described later. The dosing fuel is, for example, the same light oil as engine fuel, and in a case where the dosing fuel is to be supplied into an engine cylinder, the dosing fuel is supplied through post-injection by a fuel injection device for injection into the engine cylinder. In addition, in the present embodiment, it is possible to supply fuel into an exhaust gas by means of the fuel injection device 172 for dosing which is provided in the inlet pipe 12, and it is possible to cause the fuel to flow into the DOC device 30 together with the exhaust gas.

[Reducing Agent Supply Device]

The reducing agent supply device 4 is a device that injects an aqueous urea solution 7 into an exhaust gas as an aqueous reducing agent solution, and the reducing agent supply device 4 includes a pump unit 40 that pressure-feeds the aqueous urea solution 7, a tank 50 in which the aqueous urea solution 7 is stored, an injection nozzle 60 that injects the aqueous urea solution 7 into the path 11 (the outlet pipe 13), and a reducing agent supply channel 70 through which the aqueous urea solution 7 that is supplied from the tank 50 to the injection nozzle 60 by the pump unit 40 flows. The reducing agent supply device 4 may include the control device 8 and may not include the control device 8.

[Pump Unit]

The pump unit 40 includes a pump 41 that pressure-feeds the aqueous urea solution 7, the direction switching valve 42, a pressure gauge 43, a check valve 44, and an orifice 46. Furthermore, the pump unit 40 includes three ports 451, 452, and 453. The port 451 is an inlet port of the pump unit 40, and the port 451 and the direction switching valve 42 are connected to each other through a first channel 471. The port 452 is an outlet port of the pump unit 40, and the direction switching valve 42 and the port 452 are connected to each other through a second channel 472. The port 453 is a return port through which the aqueous urea solution 7 returns to the tank 50, and the port 453 is connected to a third channel 473 that branches off from the second channel 472. The port 451 is provided with a screening filter 461 for a pump inlet and the screening filter 461 prevents a foreign substance from entering the pump 41. An intermediate portion of the second channel 472 is provided with a filter 462 and the filter 462 prevents a foreign substance from flowing out. The port 453 is provided with a screening filter 463, the check valve 44, and the orifice 46. The pressure gauge 43 is disposed in the third channel 473. Since the third channel 473 communicates with the second channel 472, the pressure gauge 43 detects an in-system pressure P of the second channel 472 and a second reducing agent supply channel 72.

[Reducing Agent Supply Channel]

The tank 50 and the port 451 are connected to each other through a first reducing agent supply channel 71. The port 452 and the injection nozzle 60 are connected to each other through the second reducing agent supply channel 72. Therefore, the first reducing agent supply channel 71 and the second reducing agent supply channel 72 constitute the reducing agent supply channel 70 for supply of the aqueous urea solution 7, which is a reducing agent, from the tank 50 to the injection nozzle 60. In addition, the port 453 and the tank 50 are connected to each other through a bypass channel 73. In addition, specifically, the first reducing agent supply channel 71, the second reducing agent supply channel 72, and the bypass channel 73 are composed of hoses.

An end portion of the first reducing agent supply channel 71 that is on the tank 50 side is disposed near a bottom surface of the tank 50 so that the aqueous urea solution 7 can be sucked. In addition, in addition, the end portion of the first reducing agent supply channel 71 is provided with a tank suction port strainer 75, so that a foreign substance is prevented from being sucked into the reducing agent supply channel 70. An end portion of the bypass channel 73 that is on the tank 50 side is disposed at a position higher than a liquid surface of the aqueous urea solution 7 in the tank 50. Furthermore, the tank 50 is provided with a breather or the like to maintain the internal pressure at the atmospheric pressure.

[Pump]

An electric pump is typically used as the pump 41, and the driving of the pump 41 is controlled by the control device 8. An inlet-side channel 411 and an outlet-side channel 412 of the pump 41 are connected to the direction switching valve 42.

[Direction Switching Valve]

The direction switching valve 42 is an electromagnetic direction control valve that switches, in accordance with a control signal from the control device 8, a direction in which the aqueous urea solution 7 pressure-fed by the pump 41 flows between a forward flow direction (FIG. 1) from the tank 50 to the injection nozzle 60 and a reverse flow direction (FIG. 2) from the injection nozzle 60 to the tank 50. As shown in FIG. 1, in a case where no control signal is output from the control device 8 and a solenoid is not electrified, the direction switching valve 42 causes the first channel 471 to communicate with the inlet-side channel 411 and causes the second channel 472 to communicate with the outlet-side channel 412, so that the forward flow direction is set as a direction in which the aqueous urea solution 7 flows. In this case, when the pump 41 is operated, the aqueous urea solution 7 is sucked from the first reducing agent supply channel 71 into the inlet-side channel 411 via the first channel 471, and the aqueous urea solution 7 is discharged from the outlet-side channel 412 into the second reducing agent supply channel 72 via the second channel 472. Therefore, the pump 41 and the direction switching valve 42 set in the forward flow direction constitute pressure-feeding means of the present disclosure.

On the other hand, as shown in FIG. 2, in a case where a control signal is output from the control device 8 and the solenoid is electrified, the direction switching valve 42 causes the first channel 471 to communicate with the outlet-side channel 412 and causes the second channel 472 to communicate with the inlet-side channel 411, so that the direction in which the aqueous urea solution 7 flows is switched to the reverse flow direction. In this case, when the pump 41 is operated, the aqueous urea solution 7 is sucked from the second reducing agent supply channel 72 into the inlet-side channel 411 via the second channel 472, and the aqueous urea solution 7 is returned to the tank 50 side from the outlet-side channel 412 via the first channel 471 and the first reducing agent supply channel 71. Therefore, the pump 41 and the direction switching valve 42 set in the reverse flow direction constitute retraction means of the present disclosure.

Note that a configuration that switches the direction in which the aqueous urea solution 7 flows is not limited to a configuration in which the direction switching valve 42 is used as in the present embodiment. For example, two pumps may be provided for discharge and retraction, respectively. In such a case, the aqueous urea solution 7 may be discharged in the forward flow direction with a discharge pump operated and a retraction pump stopped and the aqueous urea solution 7 may be retracted back in the reverse flow direction with the discharge pump stopped and the retraction pump for operated.

[Injection Nozzle]

The injection nozzle 60 is an aqueous urea solution injection device (hereinafter, the injection nozzle 60 may also be referred to as a urea injection device) that is controlled by the control device 8 to be turned on (electrified) or turned off (non-electrified) and that injects the aqueous urea solution 7 pressure-fed by the pump 41 into the path 11 (the outlet pipe 13). As shown in FIGS. 3 and 4, a needle valve 62 that is disposed in a case 61 to be movable in an axial direction is caused to advance and retract with respect to a valve seat 64 communicating with an injection hole 63 by means of an electromagnet 65 and a spring 66 so that a valve-open state and a valve-closed state are controlled. That is, as shown in FIG. 4, in a case where a control signal is output from the control device 8 and the electromagnet 65 is electrified, the needle valve 62 is separated from the valve seat 64 by a magnetic force generated by the electromagnet 65, the aqueous urea solution 7 inside the needle valve 62 flows between the needle valve 62 and the valve seat 64, and the injection nozzle 60 enters the valve-open state where the aqueous urea solution 7 can be injected through the injection hole 63. On the other hand, as shown in FIG. 3, in a case where no control signal is output from the control device 8 and the electromagnet 65 is not electrified, the needle valve 62 abuts against the valve seat 64 due to pressure of the spring 66 and the aqueous urea solution 7, and the injection nozzle 60 enters the valve-closed state where no aqueous urea solution can be injected through the injection hole 63. Then, the aqueous urea solution 7 that is injected into an exhaust pipe 11 through the injection hole 63 with the injection nozzle 60 being in the valve-open state becomes ammonia by being hydrolyzed by the heat of an exhaust gas and reduces and purifies nitrogen oxide at an SCR 31.

[SCR Device]

The SCR device 175 reduces and purifies nitrogen oxide (NOx) in an exhaust gas by using ammonia, which is obtained through decomposition of the aqueous urea solution 7 that is injected into the exhaust gas from the reducing agent supply device 4, as a reducing agent. Note that the SCR device 175 is provided with a temperature sensor 51 that measures the outlet temperature of the SCR device 175, a temperature sensor (not shown) that measures the inlet temperature of the SCR device 175, and various sensors (not shown) such as an ammonia sensor that measures the concentration of ammonia. Note that some of these sensors can be omitted. Measurement data from each of the sensors is output to the control device 8, and the control device 8 controls the reducing agent supply device 4 based on each measurement data to perform aqueous urea solution injection control and the like. In a case where the aqueous urea solution 7 is injected from the injection nozzle 60, urea may be crystallized to precipitate in the outlet pipe 13. Therefore, it is necessary to perform a reproducing process of decomposing precipitates (urea deposits) in the outlet pipe 13 by increasing the temperature of the exhaust gas to a high temperature. The reproducing process includes, for example, automatic reproduction control that is automatically performed while the work vehicle is being operated and stationary manual reproduction executed through a manual operation performed by an operator and the reproducing process is controlled while being switched and selected between the automatic reproduction control and the stationary manual reproduction by the control device 8.

[Example of Adherence of Aqueous Urea Solution]

The aqueous urea solution 7 is frozen at a temperature equal to or lower than a certain temperature. Therefore, in order to avoid damage to the reducing agent supply device 4 (hoses of the injection nozzle (aqueous urea solution injection device) 60, the pump 41, the first reducing agent supply channel 71, the second reducing agent supply channel 72, and the like) that is caused by expansion in the case of freezing, it is necessary to perform control (hereinafter, referred to as aqueous urea solution return control) in which the aqueous urea solution 7 present between the tank 50 and the injection nozzle 60 is caused to return to the tank 50 after the engine 2 is stopped. Regarding the aqueous urea solution return control, since a flow path in the injection nozzle 60 has a particularly complicated shape, there is a case where the aqueous urea solution 7 cannot be completely collected and the aqueous urea solution 7 remains in the injection nozzle 60. In addition, as shown in FIG. 5, regarding the aqueous urea solution return control, there is a period in which an exhaust gas e from the outlet pipe 13 flows into the case 61 through the injection hole 63 when the aqueous urea solution 7 is retracted back. Therefore, the aqueous urea solution 7 changes into a crystal C1 between the needle valve 62 and the valve seat 64 or the aqueous urea solution 7 changes into a crystal C2 in a gap or the like between the needle valve 62 and the case 61. The crystals C1, C2, and the like may clog a flow path of the aqueous urea solution 7 and in a case where a clog is formed, the injection nozzle 60 may not be able to inject the aqueous urea solution 7 until the clog is removed. The clog can be removed by the reproducing process described above. However, since the reproducing process is accompanied by deterioration in fuel efficiency and occurrence of notification on the monitor 9, it is desirable to prevent a clog without the reproducing process. Therefore, in the present embodiment, as will be described later, a control for prevention of generation of the crystal C1 between the needle valve 62 and the valve seat 64, the crystal C2 in the case 61, or the like is performed at the time of the aqueous urea solution return control.

[Sensor]

The exhaust gas purification device 10 is provided with various sensors for detection of the state of the diesel engine 2 or the exhaust gas purification device 10. That is, a NOx sensor (not shown) that detects the concentration of nitrogen oxide (NOx) in an exhaust gas is disposed at the inlet pipe 12, an inlet portion or an outlet portion of the DPF device 171, the outlet pipe 13, an inlet portion of the SCR device 175, or the like. The DPF device 171 is provided with an inlet temperature sensor 31 that measures the inlet temperature of the DOC device 30, an outlet temperature sensor 45 that measures the outlet temperature of the DOC device 30, and an outlet temperature sensor 174 that measures the outlet temperature of the DPF 170. As described above, the SCR device 175 is provided with the SCR outlet temperature sensor 51 that measures the outlet temperature of the SCR device 175. A NOx sensor 52 that detects the concentration of nitrogen oxide in an exhaust gas discharged from the SCR device 175 is disposed in the outlet pipe 14 connected to the SCR device 175. The sensors are connected to the control device 8 via a controller area network (CAN) 18 and output measurement data to the control device 8.

[Control Device]

Next, a configuration of the control device 8 will be described. The control device 8 can be configured by using, for example, a computer such as a microcomputer, and includes, as shown in FIG. 6, a data acquisition unit 81 and a reducing agent supply device control unit 82 as functional configurations composed of hardware such as a computer, peripheral circuits, and peripheral devices and software such as a program or the like executed by the computer.

[Data Acquisition Unit]

The data acquisition unit 81 repeatedly acquires measurement data of each sensor such as the engine rotation speed detection device 6, the inlet temperature sensor 31, the outlet temperature sensor 45, the NOx sensor 52, and the pressure gauge 43 in a predetermined cycle.

[Reducing Agent Supply Device Control Unit]

The reducing agent supply device control unit 82 outputs control signals to the pump 41, the direction switching valve 42, and the injection nozzle 60 to control the operations thereof. That is, while the engine 2 is being operated, the reducing agent supply device control unit 82 maintains the pressure in the second channel 472 or the second reducing agent supply channel 72 at a predetermined value by performing feedback control on the pump 41 based on a pressure value detected by the pressure gauge 43. Specifically, in a case where the pressure value detected by the pressure gauge 43 when the aqueous urea solution 7 is pressure-fed by the pump 41 is higher than a preset predetermined value, the control device 8 reduces the amount of discharge of the pump 41 and in a case where the pressure value is lower than the predetermined value, the control device 8 increases the amount of discharge of the pump 41, so that the pressure in the second channel 472 or the second reducing agent supply channel 72 is maintained at the predetermined value.

In addition, the reducing agent supply device control unit 82 controls the driving of the injection nozzle 60 based on the rotation rate of the engine 2, the sensor value of the NOx sensor 52 provided on a exhaust gas downstream side with respect to the SCR device 175, and the like. Furthermore, the control device 8 executes the aqueous urea solution return control, which is control in which the aqueous urea solution 7 is removed from the injection nozzle 60, when the engine 2 is stopped.

[Aqueous Urea Solution Return Control]

The aqueous urea solution return control will be described with reference to FIGS. 7 and 8. FIG. 8 shows, with the horizontal axis being a time axis, an example of how the states of operation (the ON/OFF states) of the pump 41, the direction switching valve 42, and the injection nozzle 60 and the state of the reducing agent supply channel 70 such as the second reducing agent supply channel 72 change with time. In a case where an operator turns off a starter key of the engine 2, as shown in FIG. 7, the result of determination performed by the reducing agent supply device control unit 82 in step S101 is YES and the reducing agent supply device control unit 82 waits for a certain time (a time corresponding to a threshold value T) (from repetition of NO in step S102 to YES in step S102). The wait for the certain time in step S102 is for decreasing the temperature of the DOC 30 to a certain degree after stoppage of the engine and for example, the threshold value T is determined by using a table showing a correspondence relationship between a temperature and a waiting time.

A time at which the result of the determination in step S102 becomes YES is a time at which the aqueous urea solution return control is started. First, the reducing agent supply device control unit 82 drives the pump 41 and drives the direction switching valve 42 (step S103, a time point t0 in FIG. 8). Note that at the time point to, the injection nozzle 60 is in a state of being OFF.

Next, the reducing agent supply device control unit 82 waits for a predetermined time T1 (from repetition of NO in step S104 to YES in step S104). The predetermined time T1 is a time provided in order that the pump 41 is driven for a certain time after the direction in which the aqueous urea solution 7 flows is switched to the reverse flow direction so that a state where the pressure in the second reducing agent supply channel 72 is reduced with the injection nozzle 60 being in a state (the valve-closed state) of being OFF is achieved. In a case where a valve of the injection nozzle 60 is opened after pressure reduction, it is possible to retract back the aqueous urea solution 7 with a large pressure difference in comparison with a case where pressure reduction is not performed.

Next, the reducing agent supply device control unit 82 turns the injection nozzle 60 ON (opens a valve) and causes the injection nozzle 60 to remain ON for a time Ton (step S105, for the time Ton after a time point t1 in FIG. 8). Next, the reducing agent supply device control unit 82 turns the injection nozzle 60 OFF (closes the valve) and causes the injection nozzle 60 to remain OFF for a time Toff (step S106). Next, the reducing agent supply device control unit 82 determines whether or not the number of times of repetition of switches (switches of opening and closing) of the injection nozzle 60 is larger than a threshold value N1 (step S107). The threshold value N1 is determined based on an operation time necessary for the pump 41 in the aqueous urea solution return control. In this case, (Ton+Toff)×(N1+1) is the operation time. In a case where the number of times of repetition of switches of the injection nozzle 60 is not larger than the threshold value N1 (step S107: NO), the reducing agent supply device control unit 82 turns the injection nozzle 60 ON (opens the valve) again, causes the injection nozzle 60 to remain ON for the time Ton (step S105), turns the injection nozzle 60 OFF (closes the valve) again, causes the injection nozzle 60 to remain OFF for the time Toff (step S106), and determines whether or not the number of times of repetition of switches of the injection nozzle 60 is larger than the threshold value N1 (step S107).

In a case where the number of times of repetition of switches of the injection nozzle 60 is larger than the threshold value N1 (step S107: YES), the reducing agent supply device control unit 82 stops the driving of the pump 41 (step S108, a time point t2 in FIG. 8).

Next, the reducing agent supply device control unit 82 turns the injection nozzle 60 ON (opens the valve) and causes the injection nozzle 60 to remain ON for the time Ton (step S109 (for the time Ton after the time point t2 in FIG. 8)). Next, the reducing agent supply device control unit 82 turns the injection nozzle 60 OFF (closes the valve) and causes the injection nozzle 60 to remain OFF for a time Toff (step S110). Next, the reducing agent supply device control unit 82 determines whether or not the number of times of repetition of switches of the injection nozzle 60 is larger than a threshold value N2 (step S111). The threshold value N2 is determined based on an operation time necessary for the direction switching valve 42 in the aqueous urea solution return control. In this case, (Ton+Toff)×(N2+1) is the operation time. In a case where the number of times of repetition of switches of the injection nozzle 60 is not larger than the threshold value N2 (step S111: NO), the reducing agent supply device control unit 82 turns the injection nozzle 60 ON (opens the valve) again, causes the injection nozzle 60 to remain ON for the time Ton (step S109), turns the injection nozzle 60 OFF (closes the valve) again, causes the injection nozzle 60 to remain OFF for the time Toff (step S110), and determines whether or not the number of times of repetition of switches of the injection nozzle 60 is larger than the threshold value N2 (step S111).

In a case where the number of times of repetition of switches of the injection nozzle 60 is larger than the threshold value N2 (step S111: YES), the reducing agent supply device control unit 82 stops the driving of the direction switching valve 42 and turns the injection nozzle 60 OFF (closes the valve) (step S112). Here, the aqueous urea solution return control ends (step S113, a time point t3 in FIG. 8). After the time point t3, the reducing agent supply device control unit 82 controls, for example, the pump 41, the injection nozzle 60, and the like to adjust the pressure in the second reducing agent supply channel 72 or the like (until a time point t4 is reached). Pressure adjustment herein is performed to prevent the aqueous urea solution 7 from flowing into the injection nozzle 60, the second reducing agent supply channel 72, and the like in the forward flow direction.

Note that it is desirable that a ratio between a time for which the injection nozzle 60 is kept open and a time for which the injection nozzle 60 is kept closed during repetition of switching operations for the injection nozzle 60 is set such that Ton/(Ton+Toff) is equal to or greater than 90% to 95%, for example. The repetition of the switching operations is for preventing the aqueous urea solution 7 from being crystallized by means of vibration accompanied by the switching operations. On the other hand, basically, the aqueous urea solution can be more efficiently sucked in an aqueous urea solution sucking operation in a case where the injection nozzle 60 is open. Therefore, regarding a switching operation of the needle valve 62 of the injection nozzle 60, it is preferable that a time for which an opening operation is performed is longer than at least a time for which a closing operation is performed in each switching operation cycle.

Effect of Embodiment

According to the present embodiment, it is possible to operate (switch) the injection nozzle (the aqueous urea solution injection device) 60 and to prevent crystallization at a tip end of the injection nozzle (the aqueous urea solution injection device) 60 and crystallization in the injection nozzle (the aqueous urea solution injection device) 60 while performing the aqueous urea solution return control in which the aqueous urea solution 7 present in the injection nozzle 60 or the like of the reducing agent supply device 4 is caused to return to the aqueous urea solution tank 50. That is, according to the present embodiment, for example, it is possible to physically crush a crystal and to prevent a clog when crystallization is in progress. In this case, control performed with respect to the injection nozzle 60 can be repetitive operations of turning the injection nozzle 60 ON (fully opening the injection nozzle 60) and turning the injection nozzle 60 OFF (fully closing the injection nozzle 60). Therefore, according to the present embodiment, it is possible to prevent adherence of an aqueous urea solution in a urea injection device with simple control.

Although the embodiment of the present disclosure has been described above in detail with reference to the drawings, the specific configuration is not limited to the above-described embodiment, and design modifications and the like are included within the scope of the gist of the present disclosure. For example, a switching operation cycle for the injection nozzle 60 in the above-described aqueous urea solution return control may not be the same as that in the above-described embodiment (may be changed). However, in this case, the operation time of the pump 41 or the direction switching valve 42 is determined on a time basis instead of being determined based on the number of times of repetition. In addition, the program executed by the computer in the above-described embodiment can be partially or entirely distributed via a computer-readable recording medium or a communication line.

APPENDIX

The reducing agent supply device 4 described in the embodiment can be understood as follows.

(1) The reducing agent supply device 4 according to a first aspect of the present disclosure includes the tank 50 configured to store a reducing agent (the aqueous urea solution 7) to be supplied into an exhaust pipe (the path 11) of the engine 2, pressure-feeding means (the pump 41 and the direction switching valve 42 set in the forward flow direction) configured to pressure-feed the reducing agent in the tank 50, the reducing agent supply channel 70 through which the pressure-fed reducing agent is supplied, the injection nozzle 60 configured to inject, into the exhaust pipe, the reducing agent supplied through the reducing agent supply channel 70, retraction means (the pump 41 and the direction switching valve 42 set in the reverse flow direction) configured to retract the reducing agent in the reducing agent supply channel 70 back to the tank 50 side, and the control device 8 configured to control operation of the pressure-feeding means, the injection nozzle, and the retraction means, and the control device 8 causes the injection nozzle 60 to repeat a switching operation in a predetermined cycle while the retraction means is being operated. According to the present aspect and each of the following aspects, it is possible to prevent adherence of an aqueous urea solution in a urea injection device with simple control in which the injection nozzle 60 is repeatedly turned on (fully opened) and turned off (fully closed).

(2) The reducing agent supply device 4 according to a second aspect of the present disclosure is the reducing agent supply device 4 of (1) in which the switching operation is an operation of fully opening or fully closing a valve (the needle valve 62) provided at the injection nozzle 60. According to this aspect, it is possible to increase a physical action caused by the driving of the valve in comparison with a case where the degree to which the valve is opened and closed is limited such that the valve is not fully opened or fully closed.

(3) The reducing agent supply device 4 according to a third aspect of the present disclosure is the reducing agent supply device 4 of (1) or (2) in which the switching operation is an operation in which a time for which an opening operation in the cycle is performed is longer than a time for which a closing operation is performed. According to this aspect, it is possible to reduce influence on a retraction operation that is caused since the time for the closing operation is provided.

(4) The reducing agent supply device 4 according to a fourth aspect of the present disclosure is the reducing agent supply device 4 of (1) to (3) in which the control device 8 closes a valve of the injection nozzle 60 after the operation of the retraction means is finished. According to this aspect, the aqueous urea solution 7 can be caused to efficiently return to the tank 50 side in comparison with in a case where the valve of the injection nozzle 60 is closed before the operation of the retraction means is finished.

INDUSTRIAL APPLICABILITY

According to the above-described embodiment, it is possible to prevent adherence of an aqueous urea solution in a urea injection device with simple control.

REFERENCE SIGNS LIST

1 Work vehicle
2 Diesel engine (engine)
3 Turbocharger
4 Reducing agent supply device
6 Engine rotation speed detection device
7 Aqueous urea solution
8 Control device
9 Monitor
10 Exhaust gas purification device
11 Path (exhaust pipe)
30 Diesel oxidation catalyst device (DOC device)
31 Inlet temperature sensor
40 Pump unit
41 Pump
42 Direction switching valve
43 Pressure gauge
44 Check valve

45 Outlet temperature sensor
50 Tank
52 NOx sensor
60 Injection nozzle
62 Needle valve
63 Injection hole
70 Reducing agent supply channel
71 First reducing agent supply channel
72 Second reducing agent supply channel
73 Bypass channel
81 Data acquisition unit
82 Reducing agent supply device control unit
170 DPF
171 DPF device
172 Fuel injection device
174 Outlet temperature sensor
175 Selective catalytic reduction device (SCR device)

The invention claimed is:

1. A reducing agent supply device comprising:

a tank configured to store a reducing agent to be supplied into an exhaust pipe of an engine;

pressure-feeding means configured to pressure-feed the reducing agent in the tank;

a reducing agent supply channel through which the pressure-fed reducing agent is supplied;

an injection nozzle configured to inject, into the exhaust pipe, the reducing agent supplied through the reducing agent supply channel;

retraction means which includes a pump and configured to retract the reducing agent in the reducing agent supply channel back to a tank side using the pump; and a control device configured to control operation of the pressure-feeding means, the injection nozzle, and the retraction means, wherein the control device causes the injection nozzle to repeat a switching operation in a predetermined cycle until the pump of the retraction means is stopped.

2. The reducing agent supply device according to claim 1, wherein the switching operation is an operation of fully opening or fully closing a valve provided at the injection nozzle.

3. The reducing agent supply device according to claim 2, wherein the switching operation is an operation in which a time for which an opening operation in the cycle is performed is longer than a time for which a closing operation is performed.

4. The reducing agent supply device according to claim 1, wherein the control device closes a valve of the injection nozzle after the operation of the retraction means is finished.

5. A method for controlling a reducing agent supply device including a tank configured to store a reducing agent to be supplied into an exhaust pipe of an engine, pressure-feeding means configured to pressure-feed the reducing agent in the tank, a reducing agent supply channel through which the pressure-fed reducing agent is supplied, an injection nozzle configured to inject, into the exhaust pipe, the reducing agent supplied through the reducing agent supply channel, retraction means which includes a pump and configured to retract the reducing agent in the reducing agent supply channel back to a tank side using the pump, and a control device configured to control operation of the pressure-feeding means, the injection nozzle, and the retraction means, the method comprising:

a step of causing the injection nozzle to repeat a switching operation in a predetermined cycle until the pump of the retraction means is stopped.

6. A control device in a reducing agent supply device including a tank configured to store a reducing agent to be supplied into an exhaust pipe of an engine, pressure-feeding means configured to pressure-feed the reducing agent in the tank, a reducing agent supply channel through which the pressure-fed reducing agent is supplied, an injection nozzle configured to inject, into the exhaust pipe, the reducing agent supplied through the reducing agent supply channel, and retraction means which includes a pump and configured to retract the reducing agent in the reducing agent supply channel back to a tank side using the pump, the control device controlling operation of the pressure-feeding means, the injection nozzle, and the retraction means and causing the injection nozzle to repeat a switching operation in a predetermined cycle until the pump of the retraction means is stopped.

7. The reducing agent supply device according to claim 2, wherein the control device closes a valve of the injection nozzle after the operation of the retraction means is finished.

8. The reducing agent supply device according to claim 3, wherein the control device closes a valve of the injection nozzle after the operation of the retraction means is finished.

* * * * *